US006467892B2

(12) United States Patent
Miyakoshi

(10) Patent No.: US 6,467,892 B2
(45) Date of Patent: Oct. 22, 2002

(54) INK-JET PRINTING APPARATUS AND INK-JET PRINTING METHOD

(75) Inventor: Toshimori Miyakoshi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 31 days.

(21) Appl. No.: 09/793,442

(22) Filed: Feb. 27, 2001

(65) Prior Publication Data

US 2001/0033317 A1 Oct. 25, 2001

Related U.S. Application Data

(62) Division of application No. 09/020,385, filed on Feb. 9, 1998, now Pat. No. 6,231,175.

(30) Foreign Application Priority Data

Feb. 14, 1997 (JP) ..... 9-030134

(51) Int. Cl.[7] ..... B41J 2/17; B41J 2/01
(52) U.S. Cl. ..... 347/96; 347/101
(58) Field of Search ..... 347/96, 98, 101, 347/95, 15

(56) References Cited

U.S. PATENT DOCUMENTS

| | | | |
|---|---|---|---|
| 4,313,124 A | 1/1982 | Hara | |
| 4,345,262 A | 8/1982 | Shirato et al. | |
| 4,459,600 A | 7/1984 | Sato et al. | |
| 4,463,359 A | 7/1984 | Ayata et al. | |
| 4,538,160 A | 8/1985 | Uchiyama | |
| 4,540,996 A | 9/1985 | Saito | 347/43 |
| 4,558,333 A | 12/1985 | Sugitani et al. | |
| 4,608,577 A | 8/1986 | Hori | |
| 4,723,129 A | 2/1988 | Endo et al. | |
| 4,740,796 A | 4/1988 | Endo et al. | |
| 5,864,350 A | 1/1999 | Shioya et al. | |
| 5,907,332 A | 5/1999 | Fujita et al. | 347/15 |

FOREIGN PATENT DOCUMENTS

| | | |
|---|---|---|
| EP | 0 597 714 | 5/1994 |
| EP | 0 726 156 | 8/1996 |
| EP | 0 726 158 | 8/1996 |
| JP | 54-56847 | 5/1979 |
| JP | 59-123670 | 7/1984 |
| JP | 59-138461 | 8/1984 |
| JP | 60-71260 | 4/1985 |
| JP | 64-63185 | 3/1989 |
| JP | 5-201032 | 8/1993 |
| JP | 6-255097 | 9/1994 |
| JP | 7-81093 | 3/1995 |
| JP | 7-309024 | 11/1995 |
| JP | 8-52868 | 2/1996 |
| JP | 8-281933 | 10/1996 |
| JP | 8-281975 | 10/1996 |

*Primary Examiner*—John Barlow
*Assistant Examiner*—Michael Brooke
(74) *Attorney, Agent, or Firm*—Fitzpatrick, Cella, Harper & Scinto

(57) ABSTRACT

In the present invention, a processing liquid and an ink are ejected so that ejected regions of the processing liquid ejected in each scan by a printing head and image regions printed by black (Bk) ink printed in each scan are mutually shifted in an auxiliary scanning direction. By this, when ejection of the processing liquid is to be performed in each scan, the image region of the Bk ink ejected on the processing liquid in the preceding scan is offset from a boundary of the region, to which the processing liquid is to be ejected. Therefore, overlapping of the processing liquid on the portion where the Bk ink and the processing liquid are overlapped in the preceding scan, can be avoided. Accordingly, when printing is performed by ejecting the ink and the processing liquid which makes a coloring agent in the ink insoluble, drop-out or deterioration of color due to overlap of the processing liquid in the joint portion of the image formed in each scan by the printing head can be eliminated.

10 Claims, 5 Drawing Sheets

INK-JET PRINTING APPARATUS AND INK-JET PRINTING METHOD

This application is a divisional application of application Ser. No. 09/020,385, filed Feb. 9, 1998, now U.S. Pat. No. 6,231,175.

This application is based on Patent Application No. 30134/1997 filed Feb. 14, 1997 in Japan, the content of which is incorporated hereinto by reference.

BACKGROUND OF THE INVENTION

1. Field of the Invention

The present invention relates generally to an ink-jet printing apparatus and an ink-jet printing method. More specifically, the present invention relates to an ink-jet printing apparatus and an ink-jet printing method, in which printing is performed by ejecting an ink and a liquid making a coloring agent in the ink insoluble.

2. Description of the Related Art

The ink-jet printing system has been attracting attention in the recent years. The ink-jet printing system achieves a variety of advantages, such as capability of high speed and high density printing, ease of color printing, making the apparatus compact, and so on. Examples of such a system have been disclosed in U.S. Pat. No. 4,723,129 and U.S. Pat. No. 4,740,796.

In the ink-jet printing system, the ink which contains a water-soluble dye is typically used. Accordingly, when an image is formed on a printing medium, such as a plain paper, bleeding can be caused in the printed image by deposition of water droplets or the like, for example, due to insufficient water resistance of the dye fixed on the printing medium.

As a solution for this, an ink, in which water resistance is provided for the dye to be contained in the ink, has been used. However, it encounters problems to be solved, such as water resistance of the dye is not yet complete, and since such ink has a low solubility, it is possible to cause plugging of the ink in an ejection opening of a head and so on.

As another method for attaining water resistance, a method for improving water resistance of the image by preliminarily depositing a transparent liquid to make the dye insoluble (hereinafter referred to as "processing liquid") on the printing medium, such as a printing paper, has been developed. For example, in Japanese Patent Application Laid-open No. 63185/1989, there has been disclosed a technology to eject and deposit the processing liquid by an ink-jet printing head. In the technology disclosed in the above-identified publication, a dot diameter of the processing liquid is set greater than a dot diameter of the printing ink. As a result, even when a deposited position of the processing liquid and a deposited position of the printing ink are mutually offset, desired characteristics can be obtained.

However, when using an ink and a transparent processing liquid to make a dye in the ink insoluble, setting the dot diameter of the processing liquid greater than the dot diameter of the ink, a necessary period for fixing the ink and the processing liquid on the printing medium becomes longer than a necessary period for fixing only ink. In this case, in a serial printer which performs printing by repeating scanning by a printing head, a current cycle of scanning of the printing head can be initiated before completion of fixing of the processing liquid and the ink ejected in the immediately preceding cycle of scanning of the printing head. In the current cycle of scanning, if the processing liquid in a region located adjacent to a boundary of a printed region which has been printed in the immediately preceding scanning cycle, deposits to partly overlap with the processing liquid ejected in the immediately preceding scanning cycle, a drop-out or deterioration of color can be caused in the boundary (joint portion) of the images formed per scan.

It is considered that this problem is caused by separating the ink ejected on the processing liquid in the immediately preceding cycle of scanning by overlapping the processing liquid ejected in the current scanning cycle on the processing liquid deposited in the immediately preceding scanning cycle in the region adjacent to the boundary therebetween, to fix no coloring agent of the ink in the separated portion, if the current scanning cycle is performed before fixing of the processing liquid and the printed ink ejected in the immediately preceding scanning cycle.

Accordingly, this problem can be caused not only in the construction where the dot of the processing liquid is greater than that of the printing ink, but also in other constructions. Namely, even when the dot of the processing liquid is equal to or smaller than the dot of the printing ink, or when the dot of the processing liquid is formed with the processing liquid of an amount equal to or less than an amount of the printing ink, the foregoing problems can be caused. For example, when overlapping is caused in respective scanning regions due to registration error or another reason, a part of the dot of the processing liquid formed in the current scanning cycle may overlap with the dots of the processing liquid and the ink formed in the immediately preceding scan.

The foregoing influence of dot overlapping becomes more significant at greater ejection amounts of the processing liquid or at higher driving frequency of ejection. Under the significant influence, even if the dot diameter of the processing liquid is simply set to be greater than the dot diameter of the printing ink as described above, it is difficult to obtain desired characteristics when offset is caused in depositing positions of the processing liquid and the printing ink.

SUMMARY OF THE INVENTION

The present invention has been developed for solving the problems set forth above. Therefore, it is an object of the present invention to provide an ink-jet printing apparatus and an ink-jet printing method, which can permit to print images of good quality without causing any drop-out of color in the joint portion of the image in respective scans even when a liquid (a processing liquid) to make a coloring agent in an ink insoluble is used.

A disclosed apparatus according to the present invention comprises primary scanning means for scanning a printing medium by shifting a printing head in a predetermined direction, ejecting an ink and a liquid making a coloring agent contained in the ink insoluble through respective ejection openings, and feeding means for feeding the printing medium in a direction different from the predetermined direction by a predetermined amount; and prints an image of a dimension greater than the predetermined amount in the direction different from the predetermined direction on the printing medium by alternately repeating scanning by the primary scanning means and feeding by the feeding means; and the primary scanning means ejects the liquid in such a manner that an ejected region of the liquid does not overlap with an ejected region of the ink and the liquid within a region scanned in a preceding scan by the primary scanning means.

A disclosed method according to the present invention includes a primary scan step of scanning a printing medium by shifting a printing head in a predetermined direction, ejecting an ink and a liquid making a coloring agent contained in the ink insoluble through respective ejection openings, and a feeding step of feeding the printing medium in a direction different from the predetermined direction by a predetermined amount; and prints an image of a dimension greater than the predetermined feeding amount in the direction different from the predetermined direction by alternately repeating the primary scan step and the feeding step; and in the primary scan step, performs ejection in such a manner that an ejected region of the liquid does not overlap with an ejected region of the ink and the liquid within a region scanned in proceeding the primary scan step.

With the present invention constructed as set forth above, when printing is performed by ejecting an ink and a liquid in scans per predetermined amount of feeding distance of a printing medium, a portion where an ejected region of the liquid does not overlap with an ejected region of the ink and the liquid is formed, or a portion where an ejection amount of the liquid is smaller is formed in a boundary adjacent region. Accordingly, in a region adjacent to the boundary of respective scanning regions per paper feeding, it becomes possible to prevent the liquid ejecting in a current scanning cycle from overlapping on a portion where the ink and the liquid are ejected in the immediately preceding scanning cycle.

The above and other objects, effects, features and advantages of the present invention will become apparent from the following description of embodiments thereof taken in conjunction with the accompanying drawings.

DETAILED DESCRIPTION OF THE PREFERRED EMBODIMENTS

The preferred embodiments of the present invention will be described hereinafter in detail with reference to the accompanying drawings.

(First Embodiment)

In the shown embodiment, printing of an image is performed by scanning a printing medium with at first ejecting a processing liquid (a pre-ejected liquid) toward the printing medium and subsequently ejecting an ink of black (Bk), while shifting a printing head.

Figure 1A:
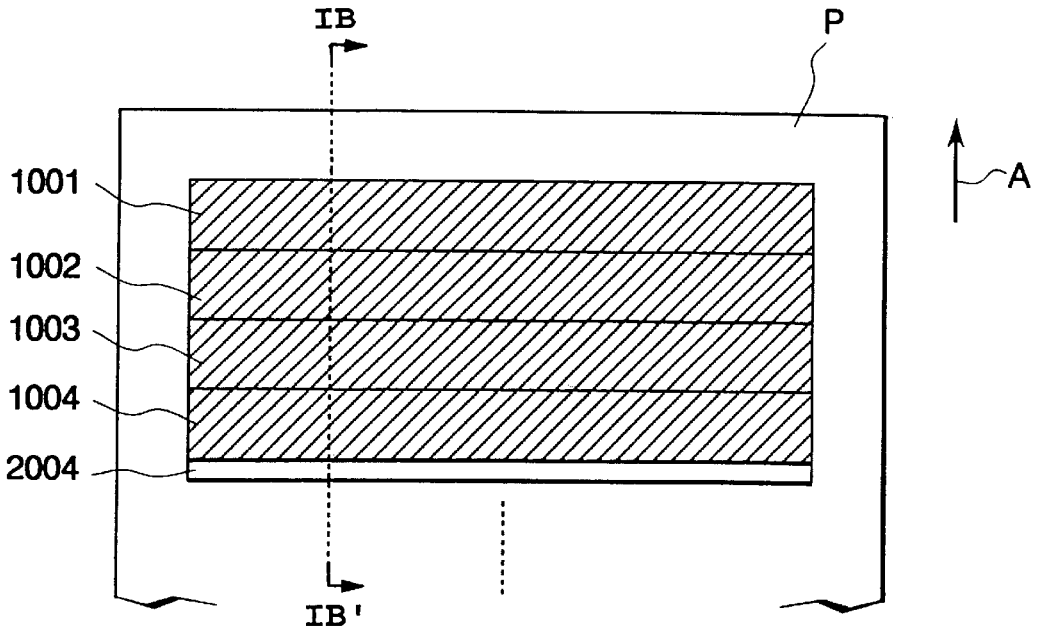
FIG. 1A is a plan view showing the first embodiment of a printing method according to the present invention.
Figure 1B:
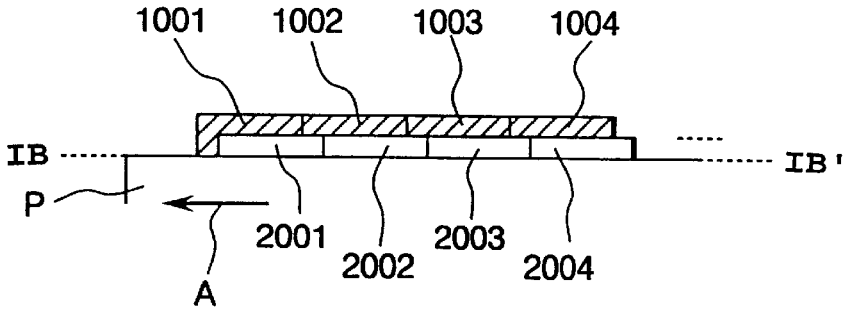
FIG. 1B is a sectional view showing the first embodiment of a printing method according to the present invention.

FIG. 1A is an illustration showing an example of printing in the shown embodiment and represents an example of 100% duty printing, namely so-called solid printing. FIG. 1B is a section taken along a line IB'—IB' of FIG. 1A. In FIGS. 1A and 1B, reference numerals 1001 to 1004 respectively represent regions of solid image formed by the Bk ink ejected in first to fourth scans by the printing head (not shown). It should be noted that the image regions 1001 to 1004 consist of an aggregate of discrete ink dots formed on a printing medium P, in practice. However, for simplification of drawing, the image regions 1001 to 1004 are illustrated as united surfaces formed by the Bk ink in FIG. 1A, and as united layers in FIG. 1B.

Similarly, concerning the processing liquid which will be explained hereinafter, ejected regions 2001 to 2004, toward which the processing liquid is ejected and deposited, are illustrated as united surfaces in FIG. 1A and as united layers in FIG. 1. In FIGS. 1A and 1B, respective ejected regions identified by reference numerals 2001 to 2004 represent regions on the printing medium P, occupied by the processing liquid ejected in advance of ejection of the Bk ink in respective ones of the first to fourth scans.

Printing by the processing liquid and the Bk ink per each scan is performed by feeding the printing medium P in an auxiliary scanning direction (a direction of arrow A in the drawing) per scan for a printing width in one scan (one primary scan), in the similar manner as that to be performed by the conventional serial printer. It should be appreciated that reaction of the processing liquid and the ink may not be caused in the upper end portion of the image region 1001 in FIG. 1A (left end portion in FIG. 1B), which is formed in the first scan. However, printing in the first scan becomes possible by an image data, on which the ink is not ejected in this portion, in practice.

As can be clear from FIGS. 1A and 1B, the regions 2001 to 2004, on which the processing liquid is ejected for deposition in respective scans and the printed regions 1001 to 1004 to be formed by the Bk ink are mutually offset in the auxiliary scanning direction. By this offset, upon scanning of a region adjacent to the boundary of the image per each scan, the Bk ink is ejected on the processing liquid ejected and deposited on the printing medium in the immediately preceding scan to prevent the Bk ink from being overlappingly ejected on the portion where the processing liquid and the Bk ink ejected in the immediately preceding scan are overlapped.

Accordingly, in the joint portion of the image in respective scans, the Bk ink ejected on the processing liquid ejected and deposited in the immediately preceding scan may not be separated by overlapping of the processing liquid in the immediately preceding scan and the processing liquid in the current scan. Therefore, a good image without any drop-out of color can be formed.

As set forth above, with the method for preventing overlapping of the processing liquid in the region adjacent to the boundary of the images to be formed in respective scans by mutually offsetting the printed region by the ink and the ejected region of the processing liquid in the auxiliary scanning direction, it becomes possible to certainly cause reaction between the ink for forming the image and the processing liquid over the entire scanning region while maintaining continuity of the image over respective scanning regions. The reason for preventing overlapping of the processing liquid ejected and deposited in respective scans at the boundary portion is that when the ejection amount of the ink or the processing liquid is to be reduced for promoting fixing in the region adjacent to the boundary, if the amount of the ink is reduced by thinning or other manner, continuity of the image can be degraded, and if the amount of the processing liquid is reduced, reaction between the ink and the processing liquid can be insufficient to make it impossible to achieve improvement of the predetermined printing ability, such as water resistance and so on.

Figure 2A:
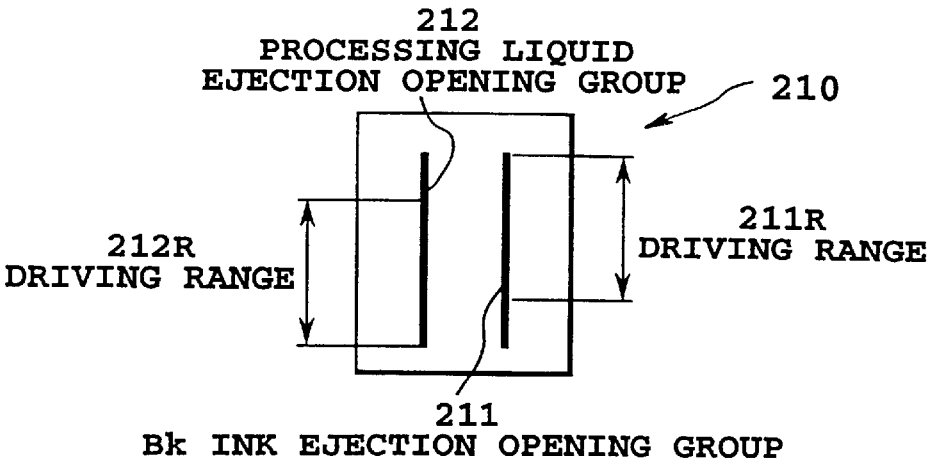
FIG. 2A is a plan view diagrammatically showing one example of an ink-jet printing head to be employed in the first embodiment.
Figure 2B:
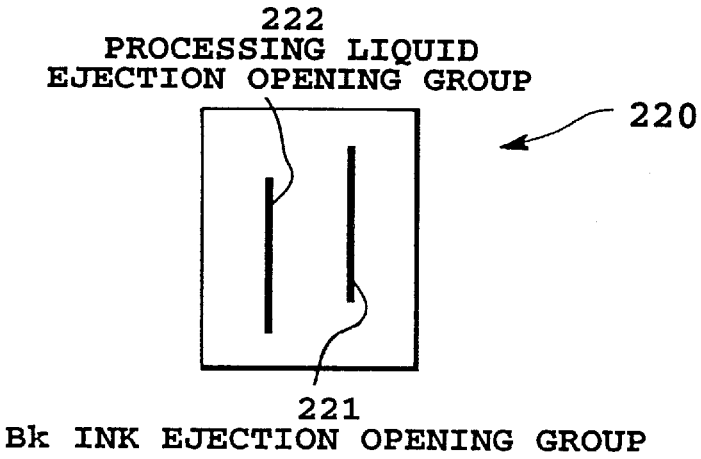
FIG. 2B is a plan view diagrammatically showing another example of the ink-jet printing head to be employed in the first embodiment.
Figure 2C:
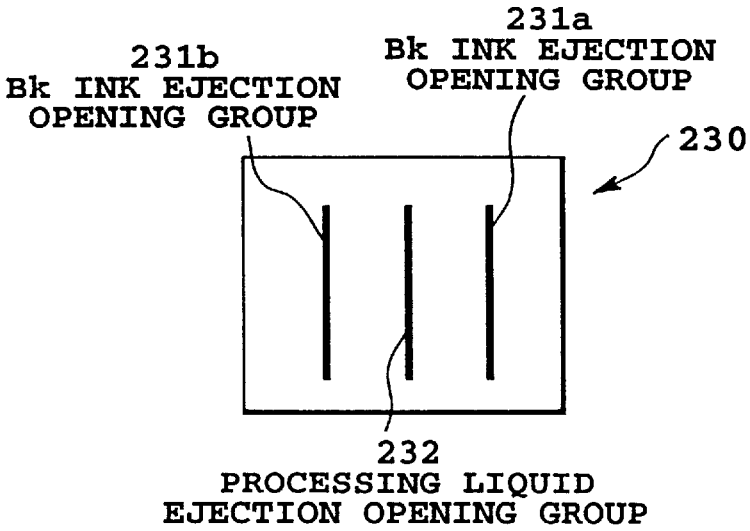
FIG. 2C is a plan view diagrammatically showing a further example of an ink-jet printing head to be employed in the first embodiment.

FIGS. 2A to 2C are plan views diagrammatically showing three examples of the printing heads which can be employed in the shown embodiment, which illustrate surfaces, in which ejection openings (nozzles) in the printing head are arranged.

A printing head 210 shown in FIG. 2A has an ejection opening group 211 for ejecting the Bk ink and an ejection opening group 212 for ejecting the processing liquid. In the ejection opening groups 211 and 212, not all of the ejection openings are driven in one scan. A range 211R of the ejection opening group 211 to be driven for ejecting the Bk ink in one scan and a range 212R of the ejection opening group 212 to be driven for ejecting the processing liquid are set with mutual offset in the auxiliary scanning direction (an arrangement direction of the ejection openings), as preliminarily shown. By this, the offset of the ejected regions shown in FIG. 1B is generated. In this case, it becomes necessary to assign the ejection data of the Bk ink and the processing liquid to respective ejection openings in the driving ranges 211R and 212R. As a method to be implemented in place of the method set forth above, it is possible to preliminarily shift ejection opening assignment of the ejection data of the Bk ink for one scan and the ejection data of the processing liquid for the scan upon feeding the ejection data from a host system or the like to the printing apparatus side, for example.

A printing head 220 shown in FIG. 2B represents an example of arrangement of the ejection opening group which does not require special processing for the printing data. An ejection opening group 221 for ejecting the Bk ink and an ejection opening group 222 for ejecting the processing liquid of the printing head 220 are preliminarily arranged with offset in the auxiliary scanning direction.

A printing head 230 shown in FIG. 2C has ejection opening groups 231*a* and 231*b* for ejecting the Bk ink and an ejection opening group 232 for ejecting the processing liquid disposed between both ejection opening groups 231*a* and 231*b*. Even with the printing head 230 having this arrangement of the ejection openings, offset of the printed regions in one scan as shown in FIG. 1B can be generated by implementing the present invention by preliminarily providing offset in the auxiliary scanning direction, between the driving ranges of the ejection opening groups 231*a* and 231*b* for ejecting the Bk ink and the driving range of the ejection opening group 232 for the processing liquid, to be driven in one scan, in the similar manner as that illustrated in FIG. 2A.

While respective printing heads shown in FIGS. 2A to 2C have the ejecting portions of the Bk ink integrated with the ejecting portion of the processing liquid, the present invention can be implemented irrespective of the printing heads like these. For example, it is clear that the present invention can be implemented in the printing head for the ink, such as the Bk ink or the like, separated from the printing head for ejecting the processing liquid. On the other hand, the kind of the ink to be ejected by the printing head for the ink is not limited to the Bk ink; the present invention can be implemented for inks of magenta, cyan, yellow and so on.

(Second Embodiment)

Figure 3A:
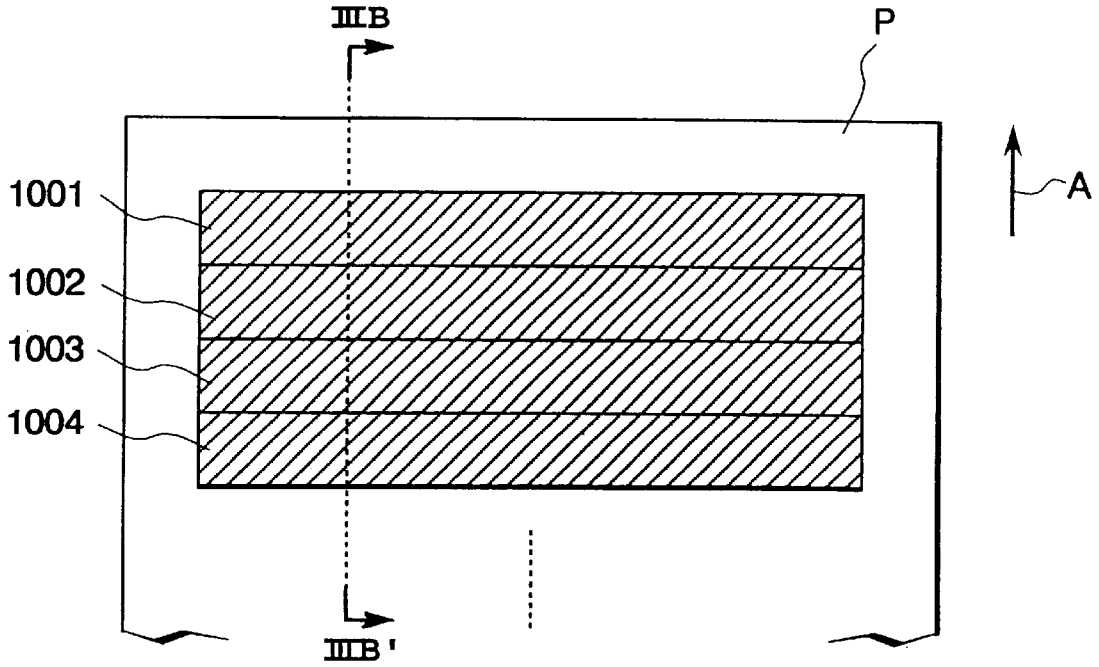
FIG. 3A is a plan view showing the second embodiment of a printing method according to the present invention.
Figure 3B:
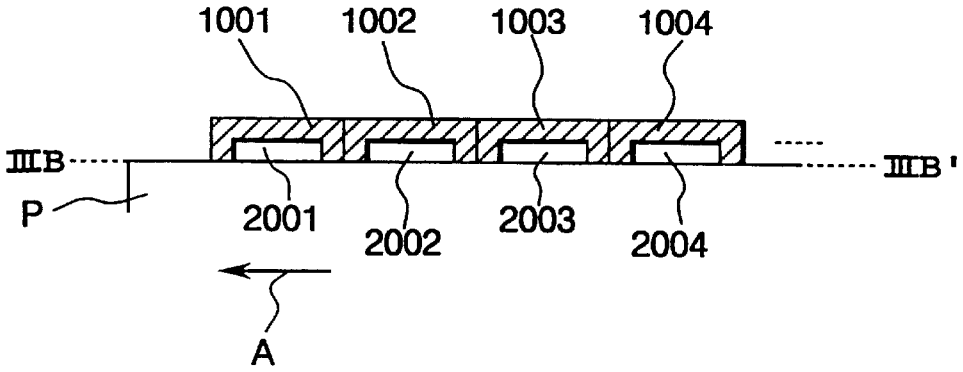
FIG. 3B is a sectional view showing the second embodiment of a printing method according to the present invention.

FIGS. 3A and 3B are plan view and section showing the second embodiment of the printing method according to the present invention, and show an example of solid printing similarly to FIGS. 1A and 1B.

In FIGS. 3A and 3B, a printing method is illustrated, in which the widths (dimensions in the feeding direction) of the ejected regions 2001 to 2004 of the processing liquid are set to be narrower than the widths (dimensions in the feeding direction) of the image printed regions 1001 to 1004 of the Bk ink. By this method, only the Bk ink is ejected to the joint region of the images to be formed in respective scans. Namely, since the processing liquid is not ejected overlappingly with the portion where the processing liquid and the Bk ink both ejected and deposited in the immediately preceding scan are overlapped, a drop-out of color in the joint portion of the images to be formed in respective scans may not be caused so as to form a good image.

It should be noted that in the construction of the printing head to be employed in the shown embodiment, similarly to the printing heads described with FIGS. 2A to 2C, the position of the ejection openings for the ink to be used in one scan may be offset in the auxiliary scanning direction with the position of the ejection openings for the processing liquid in the scan.

(Third Embodiment)

FIGS. 4A to 4D are illustrations for explaining the third embodiment of the printing method according to the present invention. In respective ones of FIGS. 4A to 4D, there is illustrated a case where the size of the printed region in one scan is longitudinal 8 dots ×lateral 10 dots, for simplification of disclosure.

Figure 4A:
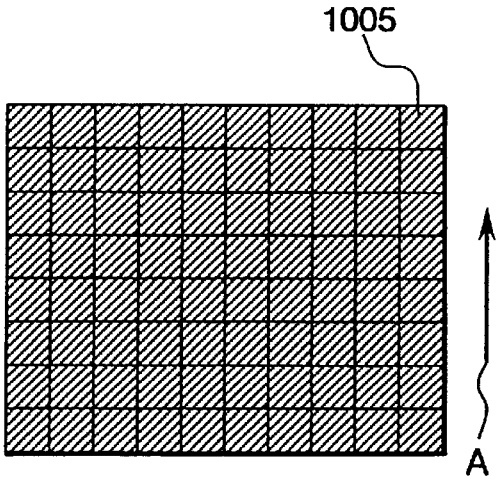
FIG. 4A is a plan view for explaining the third embodiment of a printing method according to the present invention.
Figure 4B:
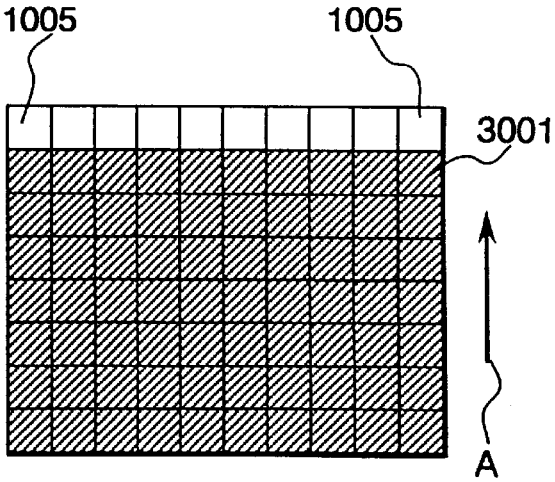
FIG. 4B is a plan view for explaining the third embodiment of a printing method according to the present invention.
Figure 4C:
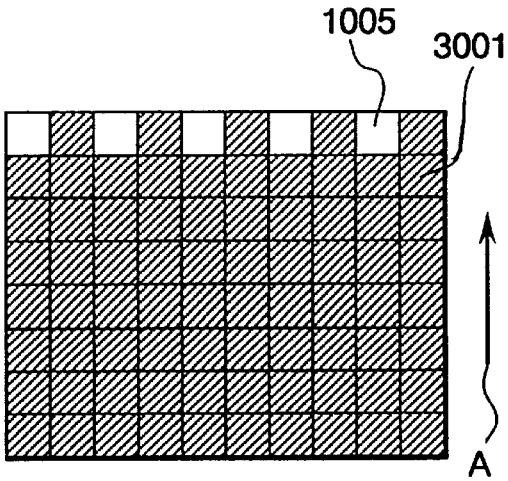
FIG. 4C is a plan view for explaining the third embodiment of a printing method according to the present invention.
Figure 4D:
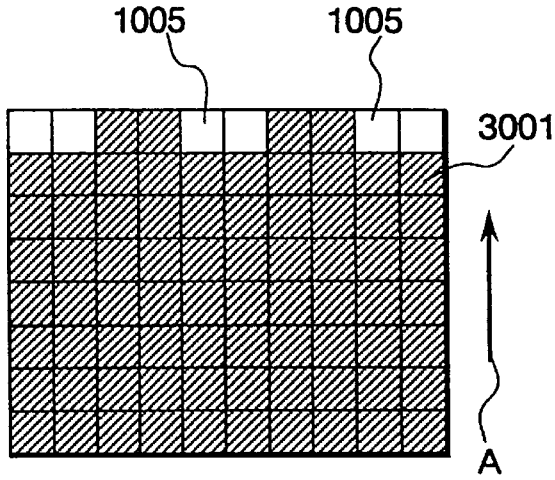
FIG. 4D is a plan view for explaining the third embodiment of a printing method according to the present invention.

FIG. 4A shows an image formed on the printing medium by the Bk ink, in which a case where all dots 1005 of the Bk ink are printed in 100% duty without thinning is illustrated. Corresponding to this image, ejection of the processing liquid (pre-ejected liquid) shown in FIGS. 4B to 4D is performed in advance of ejection of the ink. Namely, in these drawings, the dot (pixel) identified by the reference numeral 3001 corresponds to dots, on which the processing liquid is deposited.

The example shown in FIG. 4B is an example, in which the processing liquid is deposited with uniformly thinning of the dots (all dots) corresponding to one row in the uppermost portion among all dots forming the image of FIG. 4A. On the other hand, the example shown in FIG. 4C is an example, in which the processing liquid is deposited with thinning of the dots corresponding to one row in the uppermost portion among all dots forming the image of FIG. 4A in a thinning ratio of 50%.

On the other hand, upon thinning the dots of the processing liquid, instead of thinning per one dot as illustrated in FIG. 4C, thinning can be performed per two dots as shown in FIG. 4D. On the other hand, FIGS. 4B to 4D show examples of thinning of dots corresponding to one row in the uppermost portion of the image. Among the dots forming the image of FIG. 4A, the dots corresponding to single respective rows in the uppermost portion and the lowermost portion may be thinned. Also, thinning can be performed with respect to all dots forming the image.

By such construction, in the region of joint of the image by a plurality of scans, the amount of the processing liquid to be ejected overlapping with the portion where the processing liquid and the Bk ink both ejected and deposited in the immediately preceding scan is reduced to make it possible to avoid a drop-out of the color to permit formation of good image.

(Comparative Example)

Without employing the construction as in the embodiments set forth above, the printed region of the ink and the ejected region of the processing liquid in the auxiliary scanning direction in one scan were set to be the same as each other. Then, an image similar to those in the foregoing embodiments was formed.

As a result, the printed image caused drop-out of color from place to place in the joint region of the images printed in respective scans and thus a good image could not be obtained.

Figure 5:
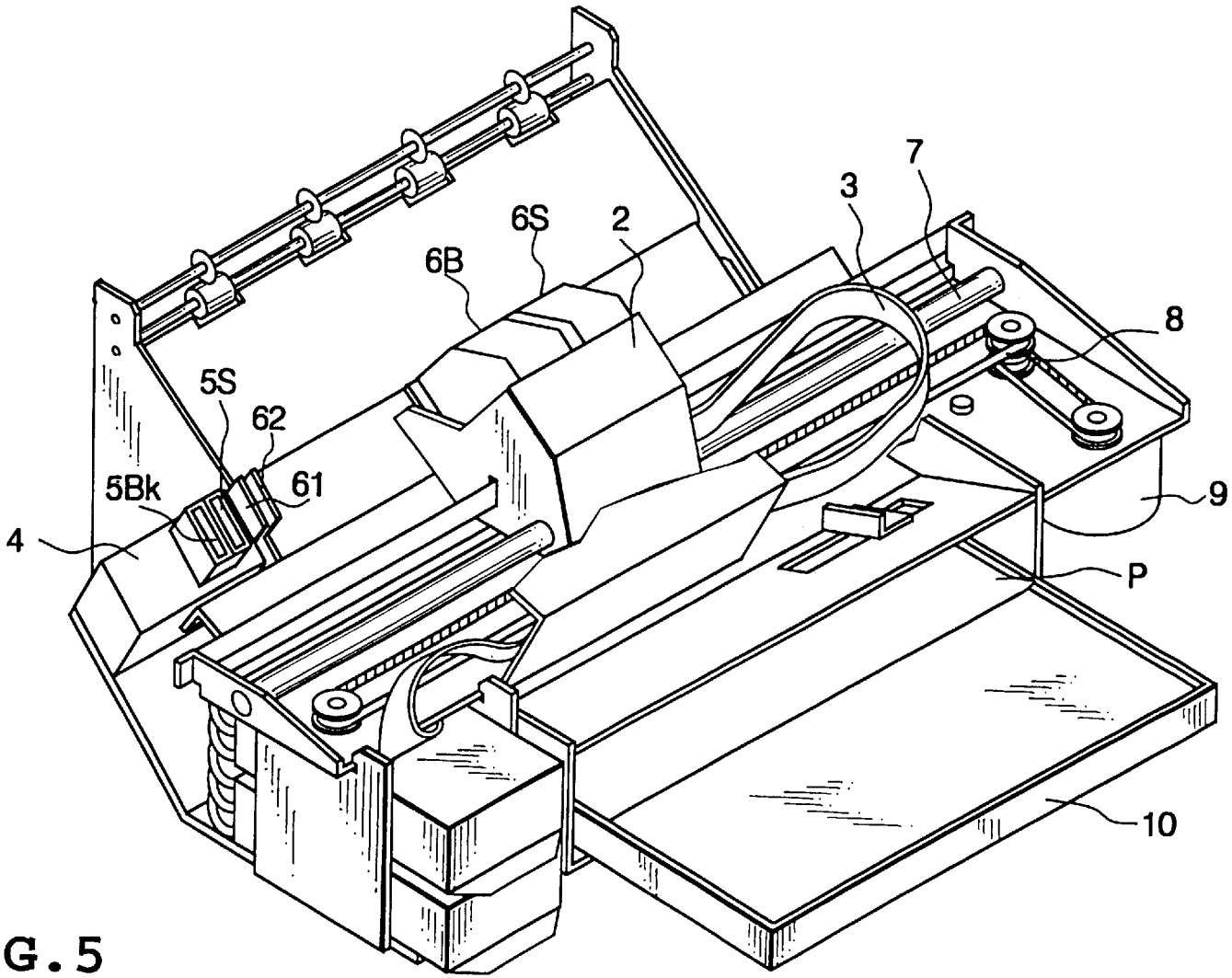
FIG. 5 is a perspective view showing a general construction of an ink-jet printing apparatus, to which the present invention is applicable.

FIG. 5 is a perspective view showing a general construction of one example of an ink-jet printing apparatus, to which the present invention is applicable.

As the printing head mounted in the printing apparatus of FIG. 5, printing heads 210 or 220 shown in FIGS. 2A or 2B may be employed. The printing head and ink tanks 6S and 6Bk are detachably mounted on a carriage 2. The carriage 2 is slidably engaged with a guide shaft 7. By this, the carriage 2 is driven to shift by a driving force of a motor 9 via a belt 8 or the like to perform scan (primary scan) by the printing head. On the other hand, the printing apparatus includes a flexible cable 3 for feeding an electric signal from a main body of the apparatus to the printing head, a recovery unit 4, a paper feeding tray 10 for feeding the printing medium P, and so on. The recovery unit 4 has capping members 5S and 5Bk corresponding to respective ejection opening groups of the printing head, and wiper blades 61 and 62 formed of a material, such as a rubber or the like.

The ink-jet printing apparatus constructed as set forth above performs scan (primary scan) of the printing head in a direction perpendicular to the feeding direction of the printing medium P to perform printing in one scan, as set forth above. On the other hand, in a non-printing state, the printing medium P is fed (auxiliary scan) by a distance equal to the printing width of the printing head. By performing plural scans of the printing head by alternately repeating the primary scan and auxiliary scan, an image continuous in the feeding direction of the printing medium can be formed.

The printing head has 256 ejection openings (nozzles) arranged in a density of 600 openings per one inch in the auxiliary scanning direction, to eject the processing liquid droplet or the ink droplet of about 17 ng from each ejection opening. Accordingly, a printing density in the auxiliary scanning direction is 600 dpi. On the other hand, printing is performed with a printing density of 600 dpi even in the primary scanning direction.

As set forth above, according to the present invention, when printing is performed by ejecting the ink and the liquid per feeding of the printing medium in the predetermined amount, the portion not overlapping with the ejected (printed) region or the portion where lesser amount of the liquid is formed. Therefore, in the region adjacent to the boundary of each scanning region per the feeding, overlapping of the liquid over the portion where the ink and the liquid are overlapped in the immediately preceding printing can be successfully avoided.

As a result, any drop-out of the color may not be caused in the joint portion of the image to permit formation of good image.

Here, as an example, the processing liquid or solution for making ink dyestuff insoluble can be obtained in the following manner.

Specifically, after the following components are mixed together and dissolved, and the mixture is pressure-filtered by using a membrane filter of 0.22 μm in pore size (tradename: Fluoropore filter manufactured by Sumitomo Electric Industries, Ltd.), thereafter, the pH of the mixture is adjusted to a level of 4.8 by adding sodium hydroxide whereby liquid Al can be obtained.

| [components of A1] | |
|---|---|
| • low molecular weight ingredients of cationic compound: | |
| stearyl-trimethyl ammonium salts (tradename: Electrostriper QE, manufactured by Kao Corporation), or stearyl-trimethyl ammonium chloride (tradename: Yutamine 86P, manufactured by Kao Corporation) | 2.0 parts by weight |
| • high molecular weight ingredients of cationic compound: | |
| copolymer of diarylamine hydrochloride and sulfur dioxide (having an average molecular weight of 5000) (tradename: polyaminesulfon PAS-92, manufactured by Nitto Boseki Co., Ltd.) | 3.0 parts by weight |
| • thiodiglycol | 10 parts by weight |
| • water | balance |

Preferable examples of ink which becomes insoluble by mixing with the aforementioned processing liquid are noted below.

Specifically, the following components are mixed together, the resultant mixture is pressure-filtered with the use of a membrane filter of 0.22 μm in pore size (tradename: Fluoroporefilter, manufactured by Sumitomo Electric Industries, Ltd.) so that yellow ink Y1, magenta ink M1, cyan ink C1 and black ink K1 can be obtained.

| [Yellow ink Y1] | |
|---|---|
| • C. I. direct yellow 142 | 2 parts by weight |
| • thiodiglycol | 10 parts by weight |
| • acetynol EH (manufactured by Kawaken Fine Chemical Co., Ltd.) | 0.05 parts by weight |
| • water | balance |

The name of "acetynol EH" described above is a tradename, and its scientific name is ethylene oxide-2,4,7,9-tetramethyl-5-decyne-4,7, -diol.

[Magenta ink M1]

having the same composition as that of Y1 other than that the dyestuff is changed to 2.5 parts by weight of C. I. acid red 289.

[Cyan ink C1]

having the same composition as that of Y1 other than that the dyestuff is changed to 2.5 parts by weight of C. I. acid blue 9.

[Black ink K1]

having the same composition as that of Y1 other than that the dyestuff is changed to 3 parts by weight of C. I. food black 2.

According to the present invention, the aforementioned processing liquid and ink are mixed with each other at the position on the printing medium or at the position where they penetrate in the printing medium. As a result, the ingredient having a low molecular weight or cationic oligomer among the cationic material contained in the processing liquid and the water soluble dye used in the ink having anionic radical are associated with each other by an ionic mutual function as a first stage of reaction whereby they are instantaneously separated from the solution liquid phase.

Next, since the associated material of the dyestuff and the cationic material having a low molecular weight or cationic oligomer are adsorbed by the ingredient having a high molecular weight contained in the processing liquid as a second stage of reaction, a size of the aggregated material of the dyestuff caused by the association is further increased, causing the aggregated material to hardly enter fibers of the printed material. As a result, only the liquid portion separated from the solid portion permeates into the printed paper, whereby both high print quality and a quick fixing property are obtained. At the same time, the aggregated material formed by the ingredient having a low molecular weight or the cationic oligomer of the cationic material and the anionic dye by way of the aforementioned mechanism has increased viscosity. Thus, since the aggregated material does not move as the liquid medium moves, ink dots adjacent to each other are formed by inks each having a different color at the time of forming a full colored image but they are not mixed with each other. Consequently, a malfunction such as bleeding does not occur. Furthermore, since the aggregated material is substantially water-insoluble, water resistibility of a formed image is complete. In addition, light resistibility of the formed image can be improved by the shielding effect of a polymer.

By the way, the term "insoluble" or "aggregation" refers to observable events in only the above first stage or in both the first and second stages.

When the present invention is carried out, since there is no need of using the cationic material having a high molecular weight and polyvalent metallic salts like the prior art or even though there is need of using them, it is sufficient that they are assistantly used to improve an effect of the present invention, so that a quantity of usage of them can be minimized. As a result, the fact that there is no reduction of a property of color exhibition that is a problem in the case that an effect of water resistibility is asked for by using the conventional cationic high molecular weight material and the polyvalent metallic salts can be noted as another effect of the present invention.

With respect to a printing medium usable for carrying out the present invention, there is no specific restriction; so called plain paper such as copying paper, bond paper or the like conventionally used can preferably be used. Of course, coated paper specially prepared for ink jet printing and OHP transparent film can preferably be used. In addition, ordinary high quality paper and bright coated paper can preferably be used.

Ink usable for carrying out the present invention should not be limited only to dyestuff ink, and pigment ink having pigment dispersed therein can also be used. Any type of processing liquid can be used, provided that pigment is aggregated with it. The following pigment ink can be noted as an example of pigment ink adapted to cause aggregation by mixing with the processing liquid Al previously discussed. As mentioned below, yellow ink Y2, magenta ink M2, cyan ink C2 and black ink K2 each containing pigment and anionic compound can be obtained.

[Black ink K2]

The following materials are poured in a batch type vertical sand mill (manufactured by Aimex Co.), where glass beads each having a diameter of 1 mm are filled as media using anion based high molecular weight material P-1 (aqueous solution containing a solid ingredient of styrene methacrylic acid ethylacrylate of 20% having an acid value of 400 and average molecular weight of 6000, neutralizing agent: potassium hydroxide) as dispersing agent to conduct dispersion treatment for three hours while water-cooling the sand mill. After completion of dispersion, the resultant mixture has a viscosity of 9 cps and a pH of 10.0. The dispersing liquid is poured in a centrifugal separator to remove coarse particles, and a carbon black dispersing element having a weight-average grain size of 10 nm is produced.

| (Composition of carbon black dispersing element) | |
|---|---|
| P-1 aqueous solution (solid ingredient of 20%) | 40 parts |
| carbon black Mogul L (tradename: manufactured by Cablack Co.) | 24 parts |
| glycerin | 15 parts |
| ethylene glycol monobutyl ether | 0.5 parts |
| isopropyl alcohol | 3 parts |
| water | 135 parts |

Next, the thus obtained dispersing element is sufficiently dispersed in water, and black ink K2 containing pigment for ink jet printing is obtained. The final product has a solid ingredient of about 10%.

[Yellow ink Y2]

Anionic high molecular P-2 (aqueous solution containing a solid ingredient of 20% of stylen-acrlylic acid methyl methaacrylate having an acid value of 280 and an average molecular weight of 11,000, neutralizing agent : diethanolamine) is used as a dispersing agent and dispersive treatment is conducted in the same manner as production of the black ink K2 whereby a yellow color dispersing element having a weight-average grain size of 103 nm is produced.

| (composition of yellow dispersing element) | |
|---|---|
| P-2 aqueous solution (having a solid ingredient of 20%) | 35 parts |
| C. I. pigment yellow 180 (tradename : Nobapalm yellow PH-G, manufactured by Hoechst Aktiengesellschaft) | 24 parts |
| triethylen glycol | 10 parts |
| diethylenglycol | 10 parts |
| ethylene glycol monobutylether | 1.0 parts |
| isopropyl alcohol | 0.5 parts |
| water | 135 parts |

The thus obtained yellow dispersing element is sufficiently dispersed in water to obtain yellow ink Y2 for ink jet printing and having pigment contained therein. The final product of ink contains a solid ingredient of about 10%.

[Cyan ink C2]

Cyan colored-dispersant element having a weight-average grain size of 120 nm is produced by using the anionic high molecular P-1 used when producing the black ink K2 as the dispersing agent, and moreover, by using the following materials by conducting dispersing treatment in the same manner as the carbon black dispersing element.

| (composition of cyan colored-dispersing element) | |
|---|---|
| P-1 agueous solution (having solid ingredient of 20%) | 30 parts |
| C. I. pigment blue 153 (tradename : Fastogen blue FGF, manufactured by Dainippon Ink And Chemicals, Inc.) | 24 parts |
| glycerin | 15 parts |
| diethylenglycol monobutylether | 0.5 parts |
| isopropyl alcohol | 3 parts |
| water | 135 parts |

The thus obtained cyan colored dispersing element is sufficiently stirred to obtain cyan ink C2 for ink jet printing and having pigment contained therein. The final product of ink has a solid ingredient of about 9.6%.

[Magenta ink M2]

Magenta color dispersing element having a weight-average grain size of 115 nm is produced by using the anionic high molecular P-1 used when producing the black ink K2 as the dispersing agent, and moreover, by using the following materials in the same manner as that in the case of the carbon black dispersing agent.

| (composition of the magenta colored dispersing element) | |
|---|---|
| P-1 aqueous solution (having a solid ingredient of 20%) | 20 parts |
| C. I. pigment red 122 (manufactured by Dainippon Ink And Chemicals, Inc.) | 24 parts |
| glycerin | 15 parts |
| isopropyl alcohol | 3 parts |
| water | 135 parts |

Magenta ink M2 for ink jet printing and having pigment contained therein is obtained by sufficiently dispersing the magenta colored dispersing element in water. The final product of ink has a solid ingredient of about 9.2%.

The present invention achieves distinct effects when applied to a recording head or a recording apparatus which has means for generating thermal energy such as electrothermal transducers or laser light, and which causes changes in ink by the thermal energy so as to the eject ink. This is because such a system can achieve high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated into the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laid-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consist of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied at the room temperature.

This is because in the ink jet system, the ink is generally temperature adjusted in a range of 30° C. –70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through-holes formed in a porous sheet as liquid or solid substances so that the ink faces the electrothermal transducers as described in Japanese Patent Application Laid-open Nos. 56847/11979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink-jet printing apparatus comprising:

primary scanning means for scanning a printing head relatively across a printing medium in a predetermined direction, the printing head for ejecting an ink and a liquid making a coloring agent contained in the ink insoluble through respective ejection openings of the printing head;

feeding means for feeding the printing medium in a sub-scanning direction different from the predetermined direction by a predetermined amount; and printing control means for controlling printing of the printing head, wherein an image having a width greater than the predetermined amount in the sub-scanning direction is formed on the printing medium by alternately repeating scanning by said primary scanning means and feeding by said feeding means, a second image region in a second primary scanning by said primary scanning means is contiguous to a first image region formed beforehand in a first primary scanning by said primary scanning means, and the ink and the liquid are ejected at a border region of the first image region and the second image region so that a boundary of the ink substantially differs from that of the liquid, the border region being a region including at least a portion of the first image region adjacent the second image region.

2. An ink-jet printing apparatus as claimed in claim 1, wherein said printing control means controls ejecting of the liquid within a predetermined range in the sub-scanning direction, and ejecting of the ink to another range offset from the liquid ejected in the predetermined range toward the first image region and having substantially the same width as that of the predetermined range in the sub-scanning direction.

3. An ink-jet printing apparatus as claimed in claim 2, wherein said printing head comprises a first ejection opening group for ejecting the liquid and comprised of a plurality of ejection openings arranged substantially in the sub-scanning direction, and a second ejection opening group for ejecting the ink and comprised of a plurality of ejection openings arranged substantially in the sub-scanning direction, and being offset relative to said first ejection opening group toward the first image region.

4. An ink-jet printing apparatus as claimed in claim 2, wherein said printing head comprises a first ejection opening group comprised of a plurality of ejection openings arranged substantially in the sub-scanning direction, and a second ejection opening group comprised of a plurality of additional ejection openings arranged substantially in the sub-scanning direction, and said printing control means comprises:

first assigning means for assigning ejection data of the liquid according to an input image signal to the ejection openings in a predetermined range of the first ejection opening group, first driving means for driving ejection openings in the predetermined range based on the assigned ejection data of the liquid, second assigning means for assigning ejection data of the ink according to the input image signal to ejection openings of the second ejection opening group in another range offset relative to the predetermined range toward the first image region, and second driving means for driving the ejection openings in the other range based on the assigned ejection data of the ink.

5. An ink-jet printing apparatus as claimed in claim 4, wherein a plurality of the second ejection opening groups are provided.

6. An ink-jet printing apparatus as claimed in claim 2, wherein said printing head comprises a first ejection opening group comprised of a plurality of ejection openings arranged within a predetermined range substantially in the sub-scanning direction, and a second ejection opening group comprised of a plurality of additional ejection openings arranged in another range, including the predetermined range, a region offset relative to the predetermined range toward the first image region, and a region offset relative to the predetermined range toward an opposite side of the first image region.

7. An ink-jet printing apparatus as claimed in claim 2, wherein said printing head comprises a first ejection opening group comprised of a plurality of ejection openings arranged substantially in the sub-scanning direction, and a second ejection opening group comprised of a plurality of additional ejection openings arranged substantially in the sub-scanning direction, and said printing control means comprises:

first assigning means for assigning ejection data of the liquid according to an input image signal to the ejection openings in a predetermined range of the first ejection opening group, first driving means for driving ejection openings in the predetermined range based on the assigned ejection data of the liquid, second assigning means for assigning ejection data of the ink according to the input image signal to ejection openings of the second ejection opening group in another range, including the predetermined range, a region offset relative to the predetermined range toward the first image region, and a region offset relative to the predetermined range toward an opposite side of the first image region, and second driving means for driving the ejection openings in the other range based on the assigned ejection data of the ink.

8. An ink-jet printing apparatus as claimed in claim 7, wherein a plurality of the second ejection opening groups are provided.

9. An ink-jet printing method comprising the steps of:

scanning a printing head relatively across a printing medium in a predetermined direction, the printing head for ejecting an ink and a liquid making a coloring agent contained in the ink insoluble through respective ejection openings of the printing head;

feeding the printing medium in a sub-scanning direction different from the predetermined direction by a predetermined amount; and controlling printing of the printing head, wherein an image having a width greater than the predetermined amount in the sub-scanning direction is formed on the printing medium by alternately repeating scanning in said scanning step and feeding in said feeding step, a second image region in a second scanning in said scanning step is contiguous to a first image region formed beforehand in a first scanning in said scanning step, and the ink and the liquid are ejected at a border region of the first image region and the second image region so that a boundary of the ink substantially differs from that of the liquid, the border region being a region including at least a portion of the first image region adjacent the second image region.

10. An ink-jet printing method as claimed in claim 9, wherein said printing controlling step comprises controlling ejecting of the liquid within a predetermined range in the sub-scanning direction, and ejecting of the ink to another range offset from the liquid ejected in the predetermined range toward the first image region and having substantially the same width as that of the predetermined range in the sub-scanning direction.

* * * * *

UNITED STATES PATENT AND TRADEMARK OFFICE

CERTIFICATE OF CORRECTION

PATENT NO. : 6,467,892 B2
DATED : October 22, 2002
INVENTOR(S) : Toshimori Miyakoshi It is certified that error appears in the above-identified patent and that said Letters Patent is hereby corrected as shown below:

Column 11,
Line 5, “agueous” should read -- aqueous --.
Line 45, “the eject” should read -- eject the --.

Column 15,
Line 5, should be merged in the same paragraph as line 4.
Line 6, “second” should begin a new paragraph.

Signed and Sealed this

Fifteenth Day of July, 2003

JAMES E. ROGAN
*Director of the United States Patent and Trademark Office*